US006609315B1

(12) United States Patent
Hendron et al.

(10) Patent No.: US 6,609,315 B1
(45) Date of Patent: Aug. 26, 2003

(54) AUTOMATIC BACKHOE TOOL ORIENTATION CONTROL

(75) Inventors: Scott Svend Hendron, Dubuque, IA (US); Judson P. Clark, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/285,733

(22) Filed: Oct. 31, 2002

(51) Int. Cl.[7] ..... E02F 5/02
(52) U.S. Cl. ..... 37/348; 414/700; 701/50
(58) Field of Search ..... 37/348, 382, 443; 701/50; 172/2, 3, 4.5; 414/699, 700, 701, 706, 708

(56) References Cited

U.S. PATENT DOCUMENTS

| | | | | |
|---|---|---|---|---|
| 3,974,699 A | * | 8/1976 | Morris et al. | 73/865.9 |
| 4,318,663 A | * | 3/1982 | Waite | 414/707 |
| 4,628,734 A | | 12/1986 | Watson | 73/505 |
| 4,630,685 A | * | 12/1986 | Huck et al. | 172/7 |
| 4,800,721 A | * | 1/1989 | Cemenska et al. | 60/393 |
| 4,844,685 A | | 7/1989 | Sagaser | 414/700 |
| 4,923,326 A | | 5/1990 | Fietzke | 403/371 |
| 5,002,454 A | * | 3/1991 | Hadank et al. | 414/695.5 |
| 5,160,239 A | * | 11/1992 | Allen et al. | 414/699 |
| 5,218,820 A | * | 6/1993 | Sepehri et al. | 60/463 |
| 5,356,260 A | | 10/1994 | Ikari et al. | 414/700 |
| 5,424,623 A | * | 6/1995 | Allen et al. | 318/568.18 |
| 5,576,976 A | * | 11/1996 | White | 702/190 |
| 5,850,035 A | | 12/1998 | Layton et al. | 73/504.16 |
| 6,003,373 A | | 12/1999 | Moore et al. | 73/504.16 |
| 6,233,511 B1 | * | 5/2001 | Berger et al. | 701/50 |
| 6,356,829 B1 | * | 3/2002 | Fan et al. | 701/50 |
| 6,374,153 B1 | * | 4/2002 | Brandt et al. | 700/188 |
| 6,434,437 B1 | | 8/2002 | Brandt et al. | 700/69 |

FOREIGN PATENT DOCUMENTS

| | | | |
|---|---|---|---|
| JP | 1-178622 | * | 7/1989 |
| JP | 7-180192 | * | 7/1995 |
| JP | 10-245866 | * | 9/1998 |

OTHER PUBLICATIONS

BEI Gyrochip Model AQRS; www.systron.com; Copyright 1998.

* cited by examiner

*Primary Examiner*—Victor Batson

(57) ABSTRACT

The invention comprises a backhoe with a tool pivotally attached to a dipperstick, an actuator for controllably moving the tool about its pivot, and an angular velocity sensor for sensing the angular velocity of the tool relative to an earth based coordinate system. A controller is adapted to perform a tool auto-hold function, automatically maintaining an initial tool orientation by processing the angular velocity data and commanding movement of the tool actuator to hold the angular velocity at zero. The controller is adapted to discontinue the tool auto-hold function when the operator manipulates a tool command input device affecting tool actuator movement, and resume the tool auto-hold function at the new orientation affected by the operator. Manipulation of an auto-hold command input device allows the operator to selectively enable and disable the tool auto-hold function.

5 Claims, 2 Drawing Sheets

AUTOMATIC BACKHOE TOOL ORIENTATION CONTROL

FIELD OF THE INVENTION

The present invention relates to a system for sensing and automatically controlling the orientation of a work tool.

Background of the Invention

A variety of work machines can be equipped with tools for performing a work function. Examples of such machines include a wide variety of loaders, excavators, tele-handlers, and aerial lifts. A work vehicle such as backhoe loader may be equipped with a tool, such as a backhoe bucket or other structure, for excavating and material handling functions. A swing frame pivotally attaches to the frame of the vehicle, a boom pivotally attaches to the swing frame, a dipperstick pivotally attaches to the boom, and the tool pivotally attaches to the dipperstick about a bucket pivot. A vehicle operator controls the orientation of the tool relative to the dipperstick by a tool actuator. The operator also controls the rotational position of the boom relative to the vehicle frame, and the dipperstick relative to the boom, by corresponding actuators. The aforementioned actuators are typically comprised of one or more double acting hydraulic cylinders and a corresponding hydraulic circuit.

During a work operation with a backhoe bucket, such as lifting or excavating material, it is desirable to maintain an initial orientation relative to gravity to prevent premature dumping of material, or to obtain a constant excavation shear angle. To maintain the initial backhoe bucket orientation relative to gravity, the operator is required to continually manipulate the backhoe bucket command input device to adjust the backhoe bucket orientation as the backhoe boom and dipperstick are moved during the work operation. The continual adjustment of the backhoe bucket orientation, combined with the simultaneous manipulation of a backhoe boom command input device and a dipperstick command input device inherent in movement of the backhoe boom and dipperstick, requires a degree of operator attention and manual effort that diminishes overall work efficiency and increases operator fatigue.

A number of mechanism and systems have been used to automatically control the orientation of a tool such as a backhoe bucket. Various examples of electronic sensing and control systems are disclosed in U.S. Pat. Nos. 4,923,326, 4,844,685, 5,356,260, and 6,233,511. Control systems typical of the prior art utilize position sensors attached at various locations on the work vehicle to sense and control tool orientation relative to the vehicle frame. Unlike the typical prior art, the present invention makes use of an angular velocity sensor attached to the tool to sense and maintain a fixed work tool orientation relative to an initial orientation, independent of vehicle frame orientation. The result is a simpler control system and improved tool orientation control relative to gravity.

A number of angular velocity sensors suitable for use in the present invention are commercially available. Examples of these types of angular velocity sensor are disclosed in U.S. Pat. Nos. 4,628,734, 5,850,035, 6,003,373. One example of such an angular velocity sensors is the BEI GYROCHIP® Model AQRS, marketed by the Systron Donner Internal Division of BEI Technologies of California.

SUMMARY OF THE INVENTION

The object of the present invention is to provide for an improved system for sensing and automatically controlling the orientation of a tool pivotally attached to a dipperstick of a backhoe or excavator.

The system automatically controls work tool orientation by making use of an angular velocity sensor attached to the tool to sense angular velocity of the tool relative to a global earth reference. A controller maintains the tool at a selected angular velocity.

The illustrated invention comprises a backhoe, a swing frame pivotally attached to the frame of the backhoe, a boom pivotally attached to the swing frame, a dipperstick pivotally attached to the boom, a tool pivotally attached to the dipperstick, an actuator for controllably moving the tool about its pivot, and the aforementioned angular velocity sensor. A controller processes data from the angular velocity sensor and commands movement of the tool actuator in response thereto. The illustrated embodiment also includes a tool command input device to affect movement of tool actuator, and a tool auto-hold command input device to enable a tool auto-hold function for maintaining the tool in an initial orientation.

When the tool auto-hold function is enabled, the controller maintains the tool orientation by commanding the tool actuator to move the tool such that the angular velocity sensed is zero. The controller is adapted to discontinue the tool auto-hold function when the operator manipulates the tool command input device to affect tool movement. The controller resumes tool auto-hold function once the operator discontinues manipulation of the tool command input device, reestablishing the initial tool orientation at the new orientation affected by the operator. Additionally, the operator may manipulate an auto-hold command input device to selectively enable and disable the tool auto-hold function.

DETAILED DESCRIPTION

Figure 1:
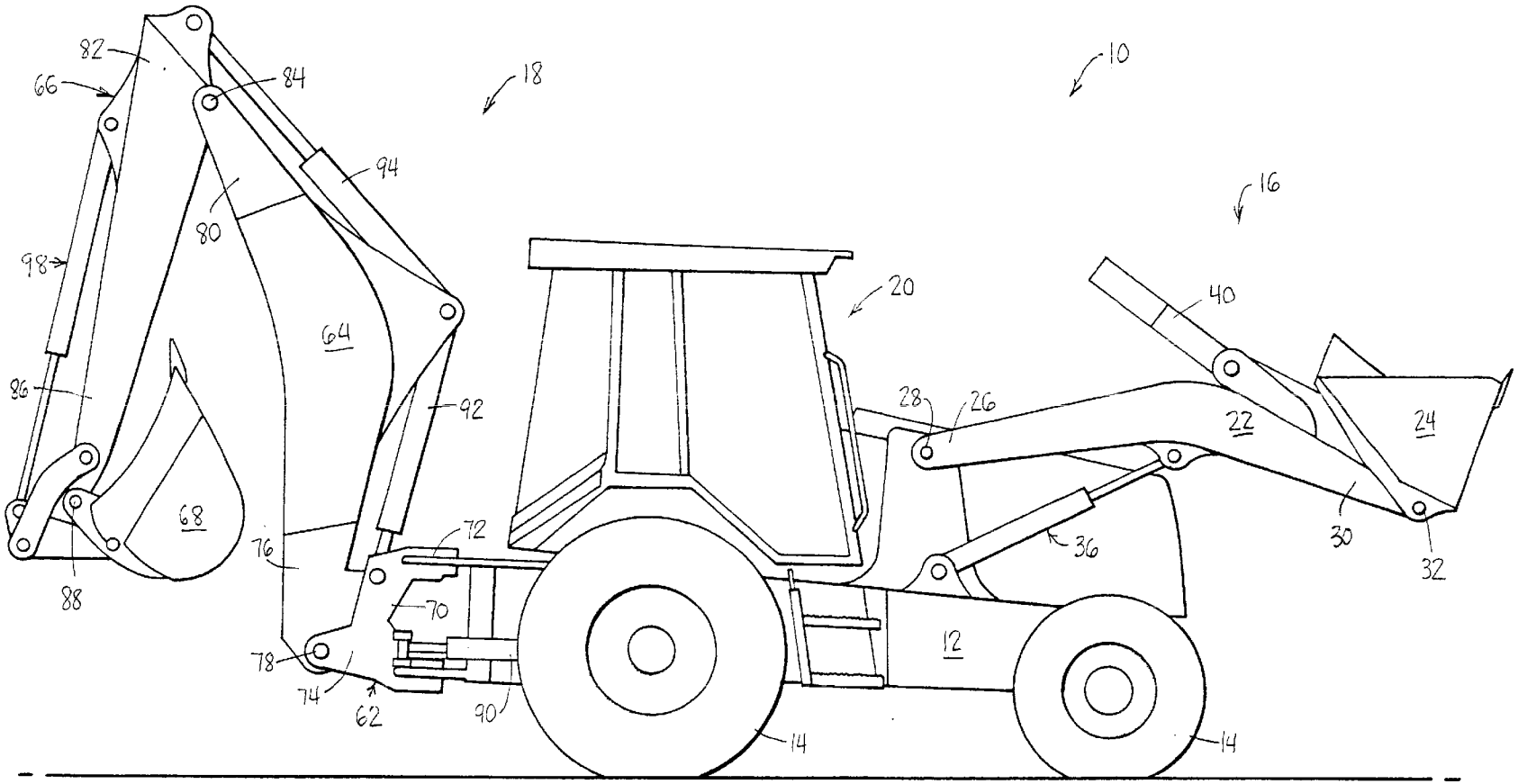
FIG. 1 is a side view of a backhoe loader.

FIG. 1 illustrates a self-propelled work vehicle, such as a backhoe loader 10. A backhoe loader 10 has a frame 12, to which are attached ground engaging wheels 14 for supporting and propelling the vehicle. Attached to the front of the vehicle is a loader assembly 16, and attached to the rear of the vehicle is a backhoe assembly 18. Both the loader assembly 16 and backhoe assembly 18 each perform a variety of excavating and material handling functions. An operator controls the functions of the vehicle from an operator's station 20.

The loader assembly 16 comprises a loader boom 22 and a tool such as a loader bucket or other structure 24. The loader boom 22 has a first end 26 pivotally attached to the frame 12 about a horizontal loader boom pivot 28, and a second end 30 to which the loader bucket 24 pivotally attaches about a horizontal loader bucket pivot 32.

A loader boom actuator, having a loader boom hydraulic cylinder 36 extending between the vehicle frame 12 and the loader boom 22, controllably moves the loader boom 22 about the loader boom pivot 28. A loader bucket actuator 38, having a loader bucket hydraulic cylinder 40 extending between the loader boom 22 and the loader bucket 24, controllably moves the loader bucket 24 about the loader bucket pivot 32. In the illustrated embodiment, the loader bucket actuator 38 comprises a loader bucket electro-hydraulic circuit 42 hydraulically coupled to the loader bucket hydraulic cylinder 40. The loader bucket electro-hydraulic circuit 42 supplies and controls the flow of hydraulic fluid to the loader bucket hydraulic cylinder 40.

The operator commands movement of the loader assembly 16 by manipulating a loader bucket command input device 44 and a loader boom command input device 46. The loader bucket command input device 44 is adapted to generate a loader bucket command signal 48 in response to manipulation by the operator, proportional to a desired loader bucket movement. A controller 50, in communication with the loader bucket command input device 44 and loader bucket actuator 38, receives the loader bucket command signal 48 and responds by generating a loader bucket control signal 52, which is received by the loader bucket electro-hydraulic circuit 42. The loader bucket electro-hydraulic circuit 42 responds to the loader bucket control signal 52 by directing hydraulic fluid to the loader bucket hydraulic cylinder 40, causing the hydraulic cylinder 40 to move the loader bucket 24 accordingly.

During a work operation with the loader bucket 24, such as lifting or transporting material, it is desirable to maintain an initial loader bucket orientation relative to gravity to prevent premature dumping of material. To maintain the initial loader bucket orientation as the loader boom 22 is moved relative to the frame 12 during a lifting operation, and as the vehicle frame 12 changes pitch when moving over uneven terrain during a transport operation, the operator is required to continually manipulate the loader bucket command input device 44 to adjust the loader bucket orientation. The continual adjustment of the loader bucket orientation requires a degree of operator attention and manual effort that diminishes overall work efficiency and increases operator fatigue.

Figure 2:
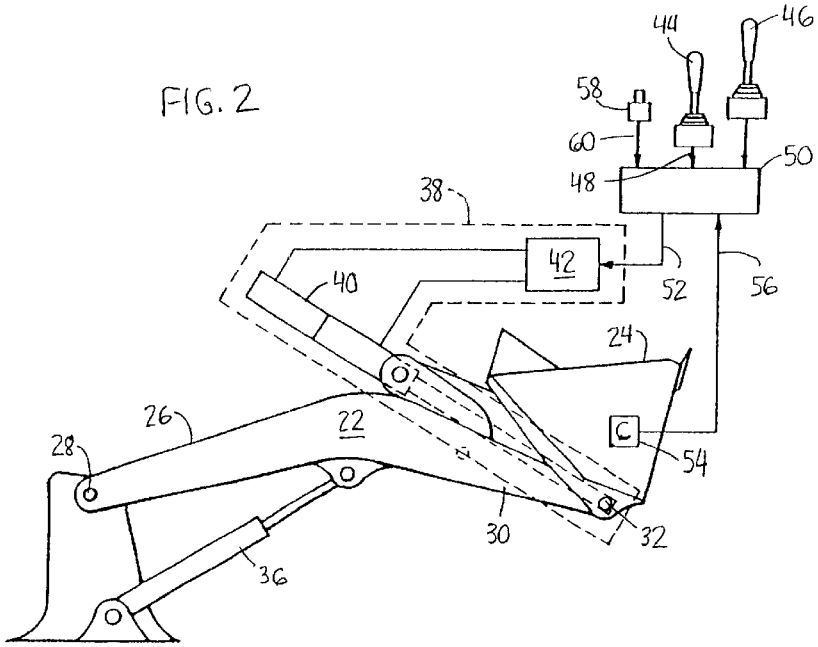
FIG. 2 is a schematic diagram of a loader bucket orientation sensing and automatic control system.

FIG. 2 illustrates an improved actuator control system adapted to automatically maintain an initial loader bucket orientation. The present invention makes use of an angular velocity sensor 54 attached to the loader bucket 24, in communication with the controller 50. The loader bucket angular velocity sensor 54 is adapted to sense angular loader bucket velocity relative to an earth based coordinate system and to continuously generate a corresponding angular velocity signal 56. The controller 50 is adapted to receive the angular loader bucket velocity signal 56 and to generate a loader bucket control signal 52 in response, causing the loader bucket actuator 38 to move the loader bucket 24 to achieve a desired loader bucket angular velocity. Where the object of the invention is an auto-hold function to maintain the initial loader bucket orientation set by the operator, relative to gravity, the desired angular loader bucket velocity is zero. Additionally, the controller 50 is adapted to suspend the auto-hold function when the operator commands movement of the loader bucket 24 when receiving the loader bucket command signal 48, and reestablishing the initial loader bucket orientation as the orientation of the loader bucket 24 immediately after the loader bucket command signal 48 terminates.

In applications requiring greater precision in maintaining the initial loader bucket orientation, the controller 50, having computational and time keeping capabilities, is adapted to solve the integral for the loader bucket angular velocity as a function of time to determine deviation from the initial loader bucket orientation. The controller 50 is adapted to generate a loader bucket control signal 52 in response to deviation exceeding a desired loader bucket orientation deviation, causing the loader bucket actuator 38 to move the loader bucket 24 to achieve the desired loader bucket orientation deviation. Where the object of the invention is an auto-hold function to maintain the initial loader bucket orientation set by the operator, relative to gravity, the desired loader bucket orientation deviation is approximately zero. Additionally, the controller 50 is adapted to discontinue responding for the desired angular loader bucket velocity when responding for the desired loader bucket orientation deviation.

In the illustrated embodiment, the present invention also utilizes a loader auto-hold command switch 58 in communication with the controller 50. The loader auto-hold command switch 58 is adapted to generate a loader auto-hold command signal 60 corresponding to a manipulation of the loader auto-hold command switch 58 by the operator to enable operation of the auto-hold function for the loader bucket 24. The controller 50 is adapted to ignore the angular loader bucket velocity signal 56 unless receiving the loader auto-hold command signal 60 from the loader auto-hold command switch 58.

The backhoe assembly 18 comprises a swing frame 62, a backhoe boom 64, a dipperstick 66, and a tool such as a backhoe bucket or other structure 68. The swing frame 62 has a first end 70 pivotally attached to the frame 12 about a vertical pivot 72, and a second end 74. The backhoe boom 64 has a first end 76 pivotally attached to the second end 74 of the swing frame 62 about a horizontal backhoe boom pivot 78, and a second end 80. The dipperstick 66 has a first end 82 pivotally attached to the second end 80 of the backhoe boom 64 about a horizontal dipperstick pivot 84, and a second end 86 to which the backhoe bucket 68 pivotally attaches about a horizontal backhoe bucket pivot 88.

A swing frame actuator, having a swing frame hydraulic cylinder 90 extending between the vehicle frame 12 and the swing frame 62, controllably moves the swing frame 62 about the vertical pivot 72. A backhoe boom actuator, having a backhoe boom hydraulic cylinder 92 extending between the swing frame 62 and the backhoe boom 64, controllably moves the backhoe boom 64 about the backhoe boom pivot 78. A dipperstick actuator, having a dipperstick hydraulic cylinder 94 extending between the backhoe boom 64 and the dipperstick 66, controllably moves the dipperstick 66 about the dipperstick pivot 84. A backhoe bucket actuator 96, having a backhoe bucket hydraulic cylinder 98 extending between the dipperstick 66 and the backhoe bucket 68, controllably moves the backhoe bucket 68 about the backhoe bucket pivot 88. In the illustrated embodiment, the backhoe bucket actuator 96 comprises a backhoe bucket electro-hydraulic circuit 100, in connection the backhoe bucket hydraulic cylinder 98, which supplies and controls the flow of hydraulic fluid to the backhoe bucket hydraulic cylinder 98.

The operator commands movement of the backhoe assembly 18 by manipulating a backhoe bucket command input device 102, a dipperstick command input device 104, a backhoe boom command input device 106, and a swing frame command input device. The backhoe bucket command input device 102 is adapted to generate a backhoe bucket command signal 108 in response to manipulation by the operator, proportional to a desired backhoe bucket movement. The controller 50, in communication with the backhoe bucket command input device 102, dipperstick command input device 104, backhoe boom command input device 106, and backhoe bucket actuator 96, receives the backhoe bucket command signal 108 and responds by generating a backhoe bucket control signal 110, which is received by the backhoe bucket electro-hydraulic circuit 100. The backhoe bucket electro-hydraulic circuit 100 responds to the backhoe bucket control signal 110 by directing hydraulic fluid to the backhoe bucket hydraulic cylinder 98, causing the hydraulic cylinder 98 to move the backhoe bucket 68 accordingly.

During a work operation with the backhoe bucket 68, such as lifting or excavating material, it is desirable to maintain an initial backhoe bucket orientation relative to gravity to prevent premature dumping of material or to obtain a constant excavation shear angle. To maintain the initial backhoe bucket orientation relative to gravity, the operator is required to continually manipulate the backhoe bucket command input device 102 to adjust the backhoe bucket orientation as the backhoe boom 64 and dipperstick 66 are moved during the work operation. The continual adjustment of the backhoe bucket orientation, combined with the simultaneous manipulation of the backhoe boom command input device 106 and the dipperstick command input device 104 inherent in movement of the backhoe boom 64 and dipperstick 66, requires a degree of operator attention and manual effort that diminishes overall work efficiency and increases operator fatigue.

Figure 3:
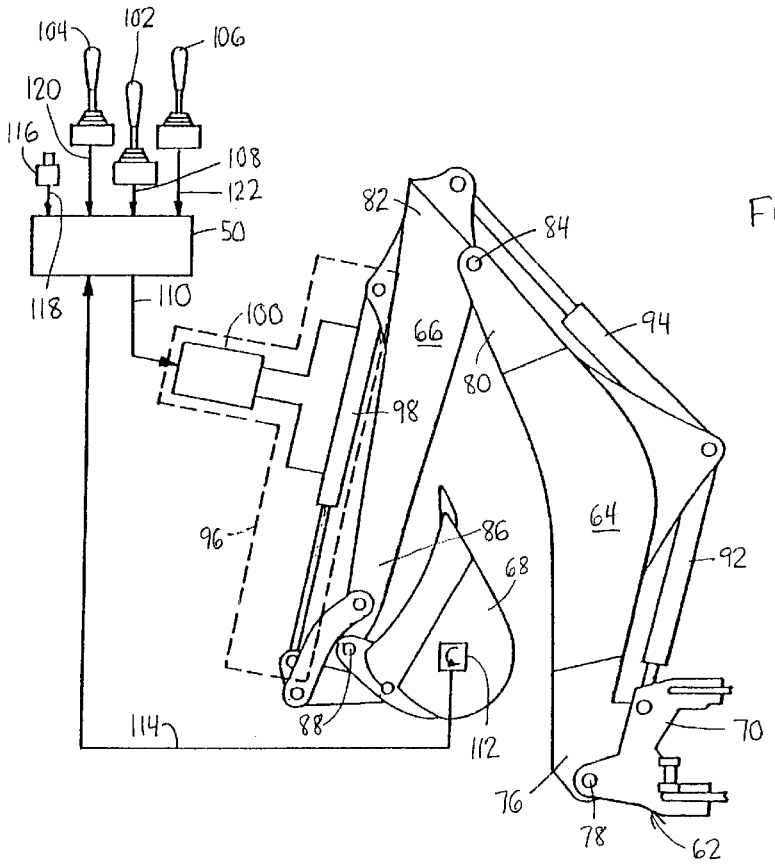
FIG. 3 is a schematic diagram of a backhoe bucket orientation sensing and automatic control system.

FIG. 3 illustrates an improved actuator control system adapted to automatically maintain an initial backhoe bucket orientation. The present invention makes use of an angular velocity sensor 112 attached to the backhoe bucket 68, in communication with the controller 50. The backhoe bucket angular velocity sensor 112 is adapted to sense angular backhoe bucket velocity relative to an earth based coordinate system and to continuously generate a corresponding angular velocity signal 114. The controller 50 is adapted to receive the angular backhoe bucket velocity signal 114 and to generate a backhoe bucket control signal 110 in response, causing the backhoe bucket actuator 96 to move the backhoe bucket 68 to achieve a desired angular backhoe bucket velocity. Where the object of the invention is an auto-hold function to maintain the initial backhoe bucket orientation set by the operator, relative to gravity, the desired angular backhoe bucket velocity is zero. Additionally, the controller 50 is adapted suspend the auto-hold function while the operator commands movement of the backhoe bucket 68 when receiving the backhoe bucket command signal 108, and reestablishing the initial backhoe bucket orientation as the orientation of the backhoe bucket 68 immediately after the backhoe bucket command signal 108 terminates.

The present invention also utilizes a backhoe auto-hold command switch 116 in communication with the controller 50. The backhoe auto-hold command switch 116 is adapted to generate a backhoe auto-hold command signal 118 corresponding to a manipulation of the backhoe auto-hold command switch 116 by the operator to enable operation of the auto-hold function for the backhoe bucket 68. The controller 50 is adapted to ignore the angular backhoe bucket velocity signal 114 unless receiving the backhoe auto-hold command signal 118 from the backhoe autohold command switch 116.

In the alternate embodiment, where a backhoe work operation is typically performed only when the vehicle is stationary, adjustments to maintain the initial backhoe bucket orientation normally result only from a corresponding movement of the backhoe boom 64 or the dipperstick 66. To minimize the period of auto-hold function for the backhoe bucket 68, the controller 50 may be adapted to ignore the angular backhoe bucket velocity signal 114 unless receiving a backhoe boom command signal 122 from the backhoe boom command input device 106, or a dipperstick command signal 120 from the dipperstick command input device 104.

Having described the illustrated embodiment, it will become apparent that various modifications can be made without departing from the scope of the invention as defined in the accompanying claims.

What is claimed is:

1. A backhoe comprising:

a frame;

a boom having a first end and a second end, the first end being pivotally attached to the frame about a boom pivot;

a dipperstick having a first end and a second end, the first end being pivotally attached to the boom about a dipperstick pivot;

a tool being pivotally attached to the second end of the dipperstick about a tool pivot, the tool being adapted to perform a work function;

a tool actuator comprising a tool hydraulic cylinder and an electronically controlled tool hydraulic circuit, the tool hydraulic cylinder extending between the dipperstick and the tool, the tool actuator being adapted to controllably move the tool about the tool pivot in response to receiving a tool control signal;

a boom actuator comprising a boom hydraulic cylinder, the boom hydraulic cylinder extending between the frame and the boom, the boom actuator being adapted to controllably move the boom about the boom pivot;

a dipperstick actuator comprising a dipperstick hydraulic cylinder, the dipperstick hydraulic cylinder extending between the boom and the dipperstick, the dipperstick actuator being adapted to controllably move the dipperstick about the dipperstick pivot;

a tool command input device being in communication with a controller, the tool command input device being adapted to generate a tool command signal in response to manipulation by an operator corresponding to a desired tool movement;

an angular velocity sensor being attached to the tool, the angular velocity sensor being adapted to sense angular velocity of the tool, and being adapted to continuously generate an angular velocity signal;

the controller having computational and time keeping capabilities, being in communication with the tool actuator, the tool command input device, and the angular velocity sensor, the controller being adapted generate the tool control signal to achieve the desired tool movement in response to receiving the tool command signal, the controller being further adapted to generate the tool control signal to continuously achieve a desired angular tool velocity in response to receiving the angular velocity signal when not receiving the tool command signal.

2. A backhoe as defined by claim 1 wherein the desired angular tool velocity is zero, resulting in maintenance of an initial tool orientation, and wherein the initial tool orientation is the orientation of the tool immediately after the tool command input device terminates generation of the tool command signal.

3. A backhoe as defined by claim 2 comprising a tool auto-hold command switch being in communication with the controller, the tool auto-hold command switch being adapted to generate a tool auto-hold command signal in response to manipulation by the operator, wherein the controller being adapted to ignore the angular velocity signal unless receiving the tool auto-hold command signal.

4. A backhoe as defined by claim 3 comprising a boom command input device being in communication with the controller, the boom command input device being adapted to generate a boom command signal in response to manipulation by the operator corresponding to a desired boom movement, wherein the controller being adapted to ignore the angular velocity signal unless receiving the boom command signal, the backhoe further comprising a dipperstick command input device being in communication with the controller, the dipperstick command input device being adapted to generate a dipperstick command signal in response to manipulation by the operator corresponding to a desired dipperstick movement, wherein the controller being adapted to ignore the angular velocity signal unless receiving the dipperstick command signal.

5. A backhoe as defined by claim 4 wherein the frame having a swing frame to which the first end of the boom being pivotally attached, and a swing frame actuator comprising a swing frame hydraulic cylinder being adapted to controllably move the swing frame about a swing frame pivot.

* * * * *